United States Patent [19]

Fraser

[11] Patent Number: 5,065,551

[45] Date of Patent: Nov. 19, 1991

[54] ABRASIVE CLEANING OR CUTTING

[75] Inventor: George M. Fraser, Barton-on-Humber, Great Britain

[73] Assignee: Cleaning Technology Limited, Scunthorpe, England

[21] Appl. No.: 555,432

[22] PCT Filed: Feb. 28, 1989

[86] PCT No.: PCT/GB89/00201

§ 371 Date: Aug. 10, 1990

§ 102(e) Date: Aug. 10, 1990

[87] PCT Pub. No.: WO89/08007

PCT Pub. Date: Sep. 8, 1989

[30] Foreign Application Priority Data

Mar. 2, 1988 [GB] United Kingdom ..... 8804970
Nov. 25, 1988 [GB] United Kingdom ..... 8827582
Nov. 25, 1988 [GB] United Kingdom ..... 8827583

[51] Int. Cl.[5] ..... B24C 3/00

[52] U.S. Cl. ..... 51/410; 51/321; 51/428; 51/436

[58] Field of Search ..... 51/410, 438, 428, 436, 51/439, 427, 321, 410, 438

[56] References Cited

U.S. PATENT DOCUMENTS 2,371,434 3/1945 Eppler .
3,323,257 6/1967 Fonti ..... 51/410
4,209,952 7/1980 Odds ..... 51/438 X
4,545,317 10/1985 Richter et al. ..... 51/438 X
4,802,312 2/1989 Glaeser et al. ..... 51/410 X

FOREIGN PATENT DOCUMENTS 652489 4/1951 United Kingdom .
2097304 11/1982 United Kingdom .

*Primary Examiner*—M. Rachuba

[57] ABSTRACT

An abrasive cleaning or cutting apparatus and method suitable particularly for underwater use at relatively low nozzle (19) overpressures (e.g. conveniently up to about 7 kg/cm$^2$ above local hydrostatic pressure). The pressurized mixing zone (1) in which abrasive particles from hopper (3), compressed air from air-line (2), and water from water supply line (15) are mixed to form the abrasive stream is arranged such that the abrasive stream includes abrasive particles at least partially surface-wetted by the liquid entrained in air or an air liquid mist as an abrasive carrier. Preferably about 5 to 10% of the liquid is in the mist the remainder going to encapsulate the abrasive particles. The apparatus also includes valves suitably automatically actuable (in response to signals from an underwater sensor) to shut off the surface apparatus from the abrasive-carrying pipeline to restrict or prevent reverse flow in the pipeline should the mixing pressure drop at the surface.

16 Claims, 6 Drawing Sheets

FIG. 6
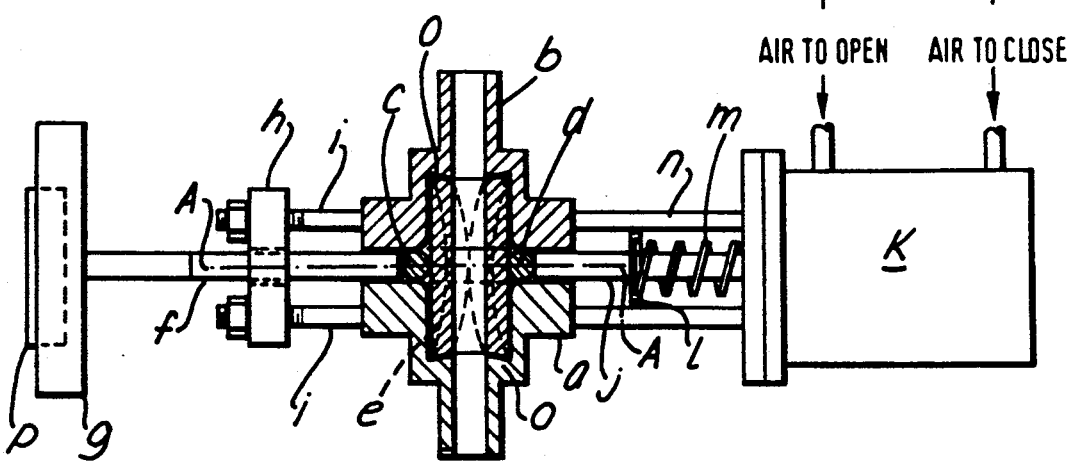
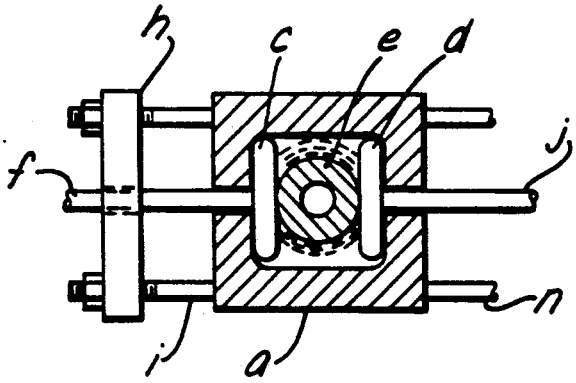
FIG. 7
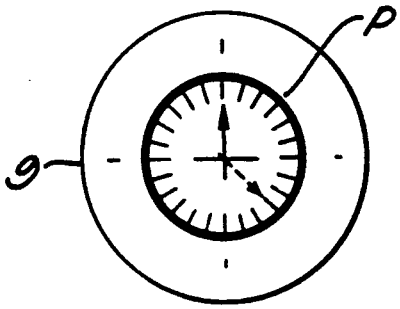
FIG. 8

ABRASIVE CLEANING OR CUTTING

TECHNICAL FIELD

This invention relates to apparatus and methods for abrasive cleaning or cutting.

BACKGROUND ART

Techniques for the underwater cleaning of surfaces have for many years relied principally on the use of manual or powered brushes, scrapers, chisels etc.

More recently, in an effort to improve cleaning efficiency, in such applications as the subsea cleaning of welded regions of metal structures prior to safety testing or inspection where high standards of cleaning are demanded, blast cleaning systems employing a high pressure jet of an abrasive slurry have been tried, using water as a carrier for the abrasive. However, the use of such slurries has been found to present many difficulties. For effective cleaning action, the slurry must emerge from the nozzle at a pressure of at least 2000 psig (141 kg/cm$^2$) above the local hydrostatic (ambient) pressure, more typically from 7000 to 15000 psig (490–1060 kg/cm$^2$) above the hydrostatic pressure. As well as the need for expensive pumping equipment and components capable of withstanding the very high delivery pressures required, large reactive forces are generated at the nozzle, causing difficulty in orientation and manipulation, and considerable danger to the diver operating the equipment. Furthermore, the equipment is prone to very high degrees of internal abrasion from the high pressure slurry.

DISCLOSURE OF THE INVENTION

The present invention is based in one aspect on the finding that by preparing the abrasive stream in a particular manner described in more detail below, a method and apparatus can be achieved permitting faster, safer, and more effective cleaning at relatively low nozzle pressures. Indeed we have found that the action of the abrasive stream can be so effective that the apparatus can be employed for the purpose of abrasive cutting of materials.

According to a first aspect of the present invention, there is provided an apparatus for abrasive cleaning and/or cutting, suitable particularly but not exclusively for underwater abrasive cleaning and/or cutting, which comprises a mixing zone for preparing an abrasive mixture comprising abrasive particles, air (the word "air" herein including also other gases) and a liquid, an outlet nozzle for directing a stream of the mixture at a surface to be cleaned and/or cut, a pipeline connecting the mixing zone to the outlet nozzle for conveying the abrasive stream to the nozzle, and means for supplying the abrasive particles, air and liquid to the mixing zone in such a way that the resultant abrasive stream includes abrasive particles at least partially (preferably substantially) surface-wetted by the liquid and entrained in air or an air/liquid mist as an abrasive carrier.

The invention further provides a method of abrasive cleaning and/or cutting in which an abrasive stream comprising a mixture of abrasive particles, air and a liquid is directed under pressure at a surface to be cleaned and/or cut, the abrasive stream including abrasive particles at least partially surface-wetted by the liquid and entrained in air or an air/liquid mist as an abrasive carrier.

It is desirable that the abrasive stream leaves the mixing zone in substantially the form of a fine mist as a propellant entraining the abrasive particles. It is preferred that the mixing is carried out under pressure. The mist and surface-wetted particles may suitably be obtained by the accurate control and metering of proportions of abrasive particles, air and liquid, to achieve reduced resistance to outflow of the abrasive stream, and a greatly enhanced performance.

Given suitable control of ingredients supplied, the required abrasive stream can be achieved without the need for an atomiser (whereby the liquid would enter the mixing zone in atomised form). The word "atomise" in the context of this invention refers to the formation of liquid droplets of sufficient size to wet the abrasive particles.

Without wishing to be bound by theory, it is believed that under suitable conditions, in the present invention the abrasive particles themselves can break up the liquid in the abrasive stream to create the required effect. Factors effecting the dispersal or atomisation conditions in the abrasive stream may include abrasive particle size, depth of operation, abrasive stream flow rate and nozzle pressure.

In more detail, the apparatus suitable provides for the liquid to impinge on the pressurised air/particle stream as initially a continuous liquid stream (i.e. without atomisation), whereby the effects of the particle stream and the inevitable particle turbulence cause the liquid stream quickly to break into droplets somewhat larger than the size of the abrasive particles themselves. To permit the necessary wetting, the mixing zone must be of sufficient length and sufficient effective volume to permit further breaking of the said droplets (due to the particle turbulence, the droplet turbulence and to mechanical effects of the mixing zone configuration, particularly the effects of the mixing zone walls, the junction with the liquid inlet port, etc.) to proceed to a state where the liquid droplets are substantially the same size as the abrasive particles. We have found that at this size the necessary degree of wetting is optimised.

By controlling the liquid supply rate to ensure that suitably only about a 5 to 10% surplus of liquid above that needed to wet the particles, and using a mixing zone of sufficient length as described above, the abrasive stream can be readily prepared.

The mixing zone suitably comprises a length of rigid tubing, into one end of which is introduced compressed air at a suitable volume and pressure. The mixing zone should have a similar internal diameter to that of the pipe introducing the compressed air, so that the velocity of the air stream is maintained. The mixing zone is preferably relatively elongated, to permit the air flow and the air-entrained abrasive particle flow to merge before contacting the liquid flow, which is preferably introduced at an angle to the air/particle flow.

The mixing zone should preferably possess an effective volume for enabling the ingredients to form an abrasive stream in which the abrasive particles are at least partially wetted, e.g. approximately 80–100% (suitably 90–95%) of the liquid encapsulating the abrasive particles, and the remainder, if any, of the liquid forming a fine mist at discharge.

For underwater use, the liquid mist should preferably contain no more than 10% of the liquid used, as a greater amount of mist has been found to impede the abrasive flow and to reduce the effect of the abrasive at the surface to be cleaned.

The mixing zone preferably has one top connection (from a pressurised abrasive hopper or vessel) through which abrasive particles are introduced into the air stream in a carefully and precisely regulated amount in proportion to the volume/pressure of air by suitable valve means as described below; then one further connection preferably downstream of the abrasives connection through which a liquid is introduced, using a variable volume positive displacement or metering pump, or control valve means, or both, to accurately control the volume of liquid thus introduced.

The top (abrasive inlet) connection should be as close to the air inlet connection as is practical, e.g. about 4" to 6" (100 mm to 150 mm), where natural turbulence of the air stream will create maximum agitation of the abrasive particles. The liquid may then be introduced at any convenient downstream point in the mixing zone as a continuous stream or jet and without necessarily using any special form of atomising nozzle, as it has been found that the combination of turbulence and impact with the abrasive particles travelling at high velocities within the air stream proves to be an adequate dispersant of the liquid into a fine mist, at the same time ensuring a thorough wetting (or encapsulating in a liquid film) of the abrasive particles, which is the effect which it is desired to obtain to achieve the optimum performance underwater.

The volume of the liquid introduced is thus equally important in proportion to the air volume as is the quantity of grit. Too little liquid and the air stream will remain dry, or some of the abrasive particles will remain dry, thus losing considerable efficiency and greatly increasing wear within the apparatus. Too much liquid and a cushion will be created between the abrasive particles and the surface to be cleaned or cut. With careful control this feature can be usefully employed, for example where only partial removal of a coating or contaminant is required.

If the liquid is introduced into the mixing zone prior to the abrasives the effect is much the same, but the dispersal of the liquid and its subsequent atomisation by the abrasive impact is less, therefore such a method is less efficient unless additional dispersant means, such as a spray or atomising device, is used. Also, more operator care is needed in order to avoid a build up of damp abrasive in the mixing chamber, when such an arrangement is used.

To maintain an even homogeneous mix desirable for maximum efficiency, the discharge orifice from the mixing zone should be about the same diameter as the air inlet, and the delivery pipe to the cleaning nozzle should have a similar internal diameter as that feeding the air into the mixing zone.

Filtration means may be incorporated into the air/gas supply pipe to remove entrained oil and moisture, as dirty air will have an adverse effect on efficiency and in the extreme could cause blockages.

The liquid will most suitably be clean fresh or sea water. For underwater cleaning or cutting the liquid will normally be the same medium as that in which the operation is carried out. Other liquids may, however, be used if desired, in which case for underwater use they should desirably have a surface tension and viscosity approximately equal to the water in which the operation is being carried out. We have found that in some circumstances performance of the apparatus can be enhanced if the liquid is heated before passing to the mixing zone (e.g. hot water may be used).

The abrasive particles may be selected from sand (e.g. sharp sand), grit, copper slag or other conventional material. The abrasive should be of good quality, dry and clean, and typically of mesh size 16–30. The particle sizes suitably range from about 0.02 mm to 2.50 mm diameter for under-water work, typically a mix within the range 0.6 to 1.5 mm diameter). Preferably the abrasive particles will be entrained in a stream of compressed air prior to entry to the mixing zone, and passed to the pressurised mixing zone through a single inlet thereof. Means may be provided for assisting a smooth flow of abrasive particles to the mixing zone during operation by the introduction of relatively high pressure air into the abrasive particle supply system.

It has been found that the mixing conditions of the present invention enable a homogeneous mix of air, water and abrasive to be obtained. This is believed to contribute to the considerably enhanced performance and the effectiveness in underwater use of a much lower nozzle pressure, typically less than 100 psig (7 kg/cm$^2$) (e.g. normally between about 20 and 50 psig (1.4 to 3.5 kg/cm$^2$) above local hydrostatic pressure for cleaning purposes and between about 30 and 80 psig (2 to 5.5 kg/cm$^2$) above local hydrostatic pressure for cutting purposes), compared with the high nozzle pressures of known systems. Without wishing to be bound by theory, it is believed that when substantially all of the abrasive particles in the stream are wetted over their surfaces in a more thorough and efficient way than available hitherto, this gives a greatly reduced resistance to flow through water after leaving the nozzle, even at extremely low nozzle pressures. It is also believed that, due to the relatively low impact velocity on the surface to be cleaned or cut, there is a relatively very low reactive force; consequently, in cleaning operations where the abrasive stream is applied across the surface to be cleaned, the surface tension of the liquid film encapsulating each abrasive particle is believed to cause it to cut across the surface of the object to be cleaned, rather than bouncing off, thus achieving maximum utilisation of the kinetic energy of the abrasive stream.

As mentioned above, the supply of the components of the abrasive stream must be carefully controlled. Typically the apparatus of the invention may have the following specification:

- Particle flow rate: 0.25 to 4.0 kg/min, suitably 2.0 kg/min.
- Liquid flow rate: 0.25 l/min to 10 liters/min, suitably 2 l/min.
- Air flow rate: 600 to 1350 m$^3$/hr.
- Mixing zone volume: 120 to 500 cm$^3$, suitably 250 cm$^3$.
- Mixing zone pressure: typically about 3.5 kg/cm$^2$ above hydrostatic pressure at the nozzle.

The air flow rate and mixing zone pressure will depend on the working depth in underwater use. According to the invention the adjustment may be manual or automatic. The liquid flow rate may also be adjusted as desired, automatically or manually as described below. The above-quoted figures are typical for working down to underwater depths of about 400 ft (122 m); for greater depths certain figures will correspondingly be changed, as readily understandable to those skilled in this art. Particularly preferred figures for compressed air supply pressures and flow rates are given in Table 1 below:

TABLE 1

| AIR COMPRESSOR RATES | | | | | |
|---|---|---|---|---|---|
| WORKING DEPTH | | MINIMUM COMPRESSED AIR SUPPLY PRESSURE | | MINIMUM COMPRESSOR CAPACITY | |
| FEET | METERS | P.S.I.G. | KG/CM$^2$ | C.F.M. | M$^3$/HR |
| 50 | 15 | 100 | 7 | 350 | 595 |
| 100 | 30 | 100 | 7 | 350 | 595 |
| 150 | 46 | 125 | 8.8 | 400 | 680 |
| 200 | 61 | 150 | 10.6 | 450 | 765 |
| 250 | 76 | 175 | 12.3 | 500 | 850 |
| 300 | 92 | 200 | 14.1 | 550 | 935 |
| 350 | 107 | 225 | 15.8 | 600 | 1020 |
| 400 | 122 | 250 | 17.6 | 650 | 1105 |

In its application at relatively low nozzle pressures, the method and apparatus of the invention provides a scouring, rather than blasting, action on the surface to be cleaned, unlike underwater cleaning methods hitherto known. Typically, the homogeneous abrasive mix prepared in the present invention is propelled across as well as onto the surface, acting to undercut as well as abrade the coating or contaminant to be removed. In this way, we have found that trapped contaminants can be released from cracks, crevices and pits in surfaces, leading to a much cleaner finish than previously attainable.

In the case of underwater abrasive cutting of materials, we have found that conventional pipeline casings, bindings or coatings such as those composed of concrete or synthetic materials can be cut through safely and efficiently using the apparatus, preferably employing a nozzle discharge pressure of around 30 to 80 psig (2 to 5.5 kg/cm$^2$) above local hydrostatic pressure, (i.e. generally slightly higher than for abrasive cleaning applications).

It is a normal requirement of underwater abrasive systems that the discharge of the abrasive stream into the pipeline should be stoppable at the surface on the command of the nozzle operator. When working at depth, however, once the stream is stopped the pressure within the mixing zone would normally drop to atmospheric as the grit vessel depressurises. Since the hydrostatic water pressure surrounding the flexible discharge pipeline increases substantially with depth, this will cause an accelerating reverse flow of the abrasive mix back through pipeline which could create a syphonic effect flooding the apparatus on the surface.

The present invention includes in a second aspect an abrasive system designed to avoid such difficulties.

According to a second aspect of the present invention, there is provided an apparatus for underwater abrasive cleaning and/or cutting, which comprises a mixing zone for preparing an abrasive mixture comprising abrasive particles, air and a liquid, an outlet nozzle for directing a stream of the mixture at a surface to be cleaned and/or cut, and a pipeline connecting the mixing zone to the outlet nozzle for conveying the abrasive stream to the nozzle, wherein valve means are provided upstream and/or downstream of the mixing zone actuable to restrict or prevent flooding of surface apparatus due to reverse-flow of abrasive mixture in the pipeline.

The valve means are preferably actuated in response to local hydrostatic pressure at the nozzle, most preferably via automatic actuators controlled by a signal from the nozzle, but may equally effectively be manually actuated by the machine operator in response to such signal or other indication of pressure loss (at the nozzle) or reversed pressure differential between the nozzle discharge pressure and the local hydrostatic pressure, whereby the local hydrostatic pressure becomes greater than the pressure either at the nozzle or the mixing zone.

The valves may suitably each comprise a resilient tube snugly retained under longitudinal compression within a chamber and seated therein by expansion against abutments provided in the chamber, the arrangement being such that the respective flowable medium may pass through the tube in use and means being provided for wholly or partially constricting the tube, wherein the abutments in the chamber are so shaped that at least part of the surface against which the tube is seated faces away from the axis of the tube.

The shape of the abutments causes the radially inner part of the tube walls to be generally more longitudinally compressed than the radially outer part, and also causes a reaction force to act on the tube walls in a direction away from the axis of the tube. Since the security of seating of the tube within the chamber is dependent on the direction and force with which the seated portions (e.g. the ends) of the tube walls and the abutments bear against one another, the valve construction effectively reduces the danger of unseating the tube even at relatively low degrees of longitudinal compression. The low degrees of longitudinal compression can allow buckling of the tube into the fluid flow path to be minimised, so lowering the amount of wear of the tube inner surface.

Known resilient tube valves also suffer from the disadvantage that they cannot be pre-set at a desired minimum and/or maximum constriction.

In a further aspect, therefore, the invention provides a valve comprising a resilient tube snugly retained under longitudinal compression within a chamber and seated therein by expansion against abutments provided in the chamber, the arrangement being such that a flowable medium may pass through the tube in use and means being provided for wholly or partially constricting the tube, wherein the said means for constricting the tube may be pre-set to provide a desired degree of constriction of the tube when actuated.

In a preferred form, the constriction means may comprise two nip heads arranged to bear against opposite sides of the tube to squeeze or release the tube by mutual respective closing or opening. One of the nip heads may suitably be manually adjustable and the other remotely actuable, whereby the valve combines the functions of a remote operated "on-off" flow control valve, having a "fail safe to close" function, with that of a manually operated flow metering or regulating valve for the control and/or regulation of flowable media.

The flowable media may for example be selected from dry powders, particles, wet or dry granules, liquids, slurries and abrasive or aggressive media whether wet or dry.

One application of the above valves is as an abrasive metering/controlling valve in apparatus where a rapid response to opening and/or closing instructions is required, e.g. in abrasive cleaning systems such as those described in British Patent No. 2097304 and in the present application.

The present invention can advantageously be used in association with the principles behind the improved low pressure abrasive cleaning apparatus which have in recent years become available. One such apparatus forms the subject of British Patent No. 2097304.

BRIEF DESCRIPTION OF DRAWINGS

For a greater understanding of the present invention, reference will now be made by way of example to the accompanying drawings, in which:

FIG. 6 shows a partially sectional side elevation view of a metering and controlling valve;

FIG. 7 shows a section on the line A—A of FIG. 6;

FIG. 8 shows a front view of a handwheel control;

BEST MODES FOR CARRYING OUT THE INVENTION

Figure 1:
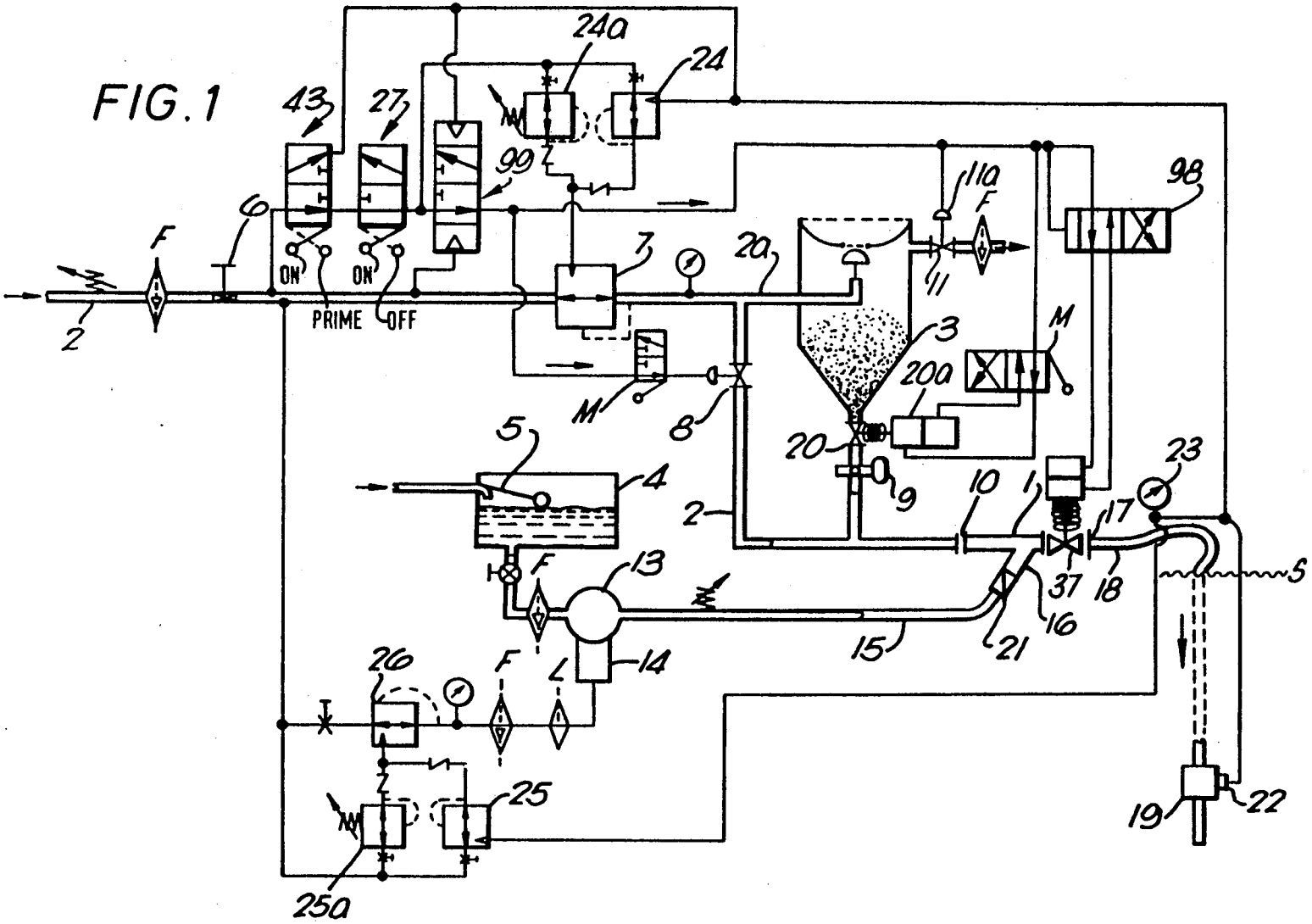
FIG. 1 shows a diagrammatic view of an underwater cleaning or cutting apparatus.
Figure 2:
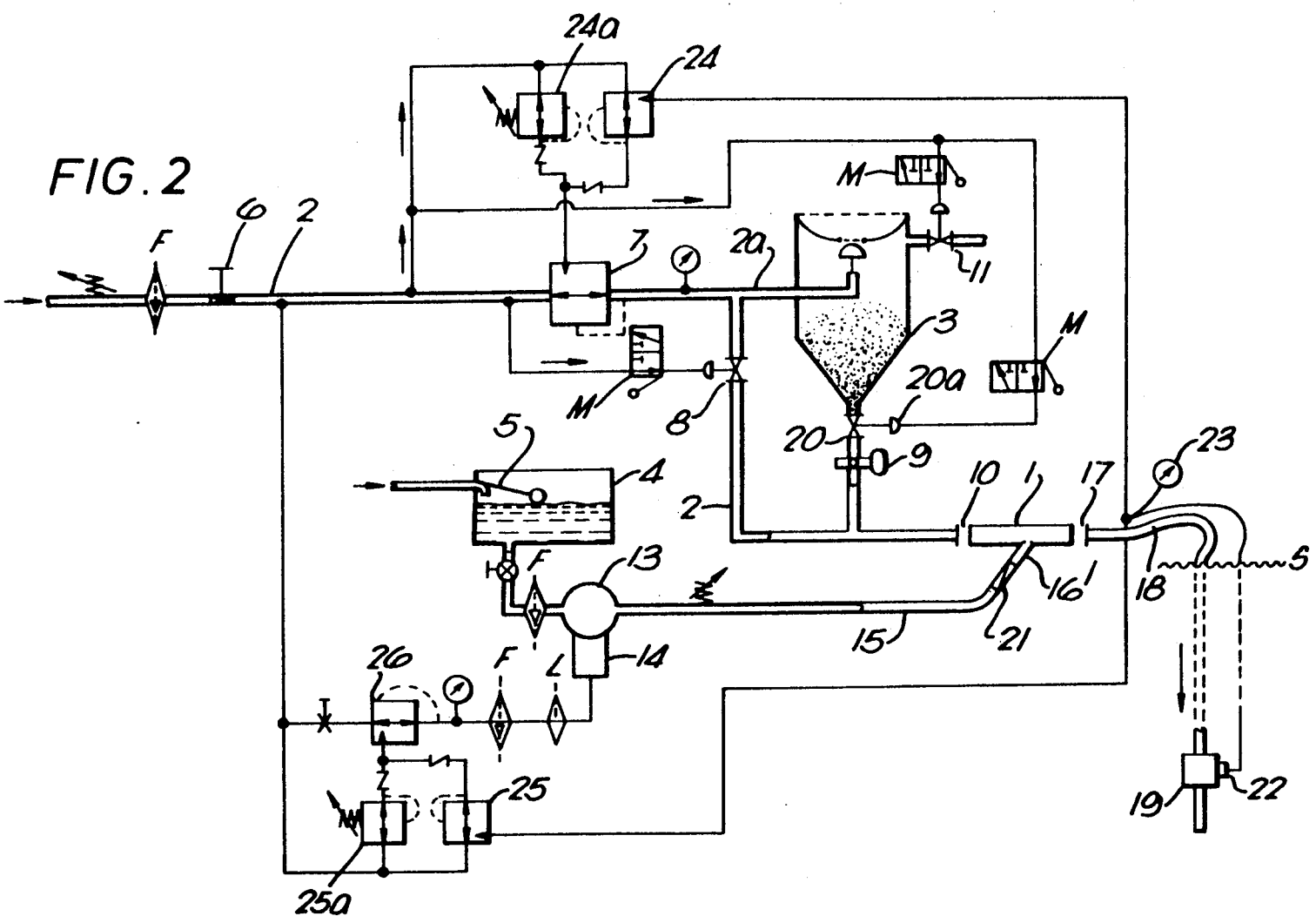
FIG. 2 shows a modified version of the apparatus of FIG. 1.

Referring particularly to FIGS. 1 and 2, where like numerals refer to like parts, an apparatus suitable for undersea abrasive cleaning or cutting work is shown. The apparatus of FIG. 2 includes means for atomising the liquid on entry to the mixing zone, whereas the apparatus of FIG. 1 includes no such atomising means. The components of the abrasive stream are supplied to a mixing zone 1 from main compressed air line 2, grit vessel 3 and water tank 4.

The water tank 4 is connected to a water supply through a ball cock arrangement 5 so as to maintain a constant head of water within the tank.

The compressed air line 2 passes from an external source (not shown) to the mixing zone 1 via a main on/off manual control valve 6 an automatic main compressed air regulator 7 (described in more detail below) and a normally-closed control valve 8 which is closed in the depressurised "off" condition.

The grit vessel 3, which is pressurised during operation via compressed air line 2a and a conventional pop-up valve, delivers the abrasive particles into the main compressed air line 2 via an accurate metering type outlet regulator 9 with setting indicator to the compressed air/abrasive inlet 10 of the mixing zone. A normally-open depressuriser valve 11 is provided to permit recharging of the grit vessel. Alternatively, duplex grit vessels (not shown) and associated valves and pipe work may be employed, connected via transfer valves, to enable continuous operation underwater even when replenishing the abrasive.

Water from the tank 4 is fed to a water pump 13 normally operated by a compressed air motor 14 fed from the same main air supply 2, in accordance with the invention of British Patent No. 2097304, and thence via supply pipe 15 (through a Y-branch 16 in FIG. 1 and an atomizer 16' in FIG. 2) and into the mixing zone 1 to blend with the compressed air/abrasive mixture to form the abrasive stream.

The pump is preferably of the positive displacement type, either of fixed or variable displacement, capable of delivering liquid at flow rates varying from one to ten liters per minute at pressures in excess of 100 psig (7 kg/cm$^2$) above the nozzle ambient pressure.

A flow regulator 26 in the air line feeding the pump air motor enables the speed of the motor and pump to be controlled and therefore the liquid flow rate to be adjusted to create the optimum abrasive stream conditions.

The pump may alternatively (not shown) be driven by any other suitable power source in conjunction with suitable speed and/or flow controls.

The components of the apparatus described above are housed in a container (not shown) at or above sea level. The mixing zone 1 has an outlet 17 leading to a discharge pipe 18 of conventional flexible construction and leads down underwater (shown in dotted lines) to a discharge nozzle 19 operable by a diver at depth, typically at depths ranging for example from 1 meter to 300 meters or even greater than 300 meters.

To avoid the danger of syphonic flooding referred to above, the conventional normally-closed valve 8 is provided in the main air supply 2 as mentioned above, and a further abrasive resistant bubble tight normally-closed control valve 20 is provided to close the abrasive delivery system should the grit vessel pressure fall. Furthermore, a conventional non-return valve 21 (which may alternatively be a normally-closed valve if desired) is provided upstream of the Y-branch 16 (in FIG. 1) or the atomizer head 16' (in FIG. 2) in the water supply line 15.

In a simplified alternative version (indicated schematically in FIG. 3) an automatically closing valve 20 of a type permitting manual incremental abrasive grit flow control may be used, and regulator 9 dispensed with. Such a valve is described below by way of example, with reference to FIGS. 6 to 10.

Figure 3:
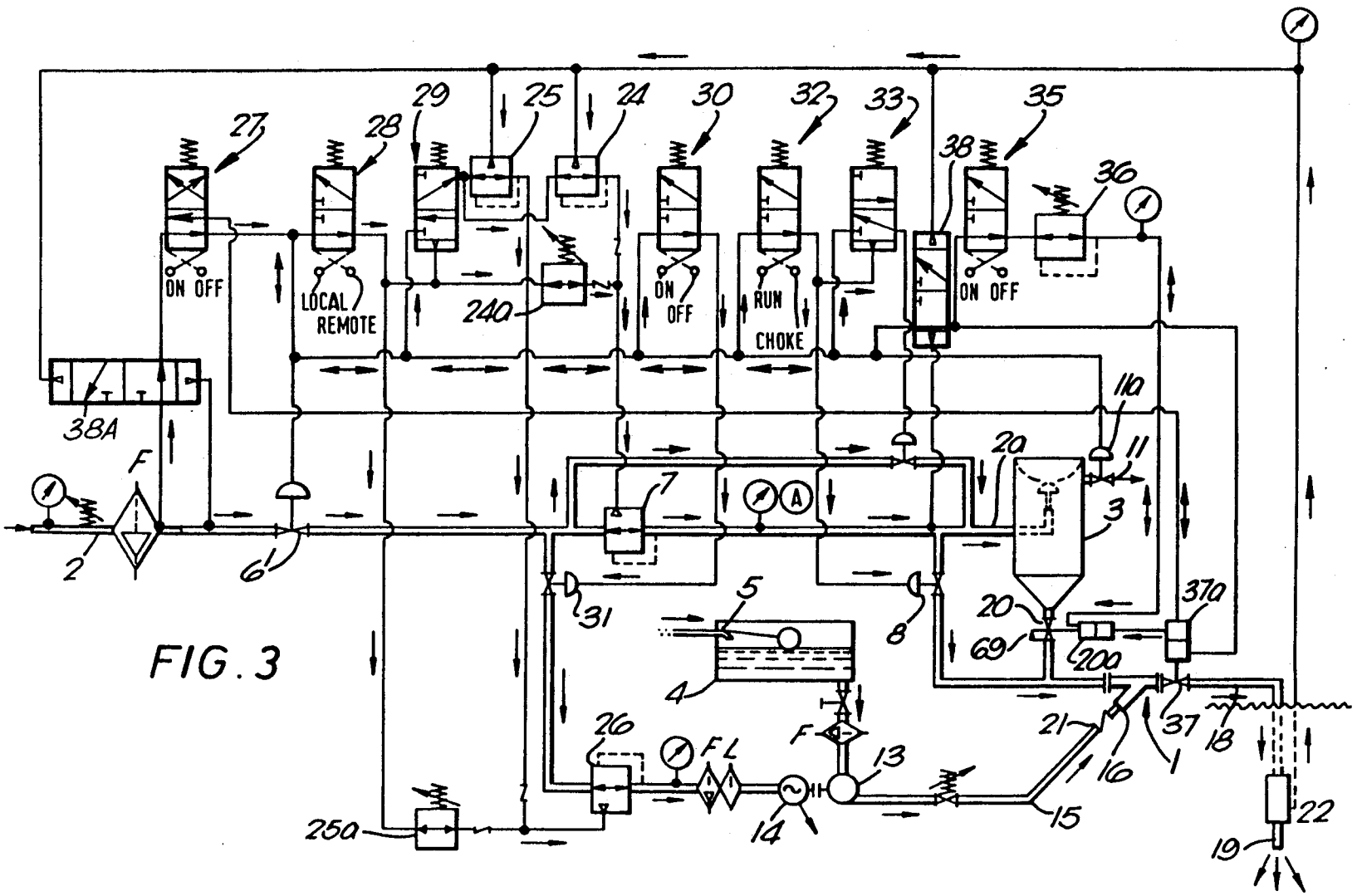
FIG. 3 shows a diagrammatic view of alternative underwater cleaning or cutting apparatus.
Figure 4:
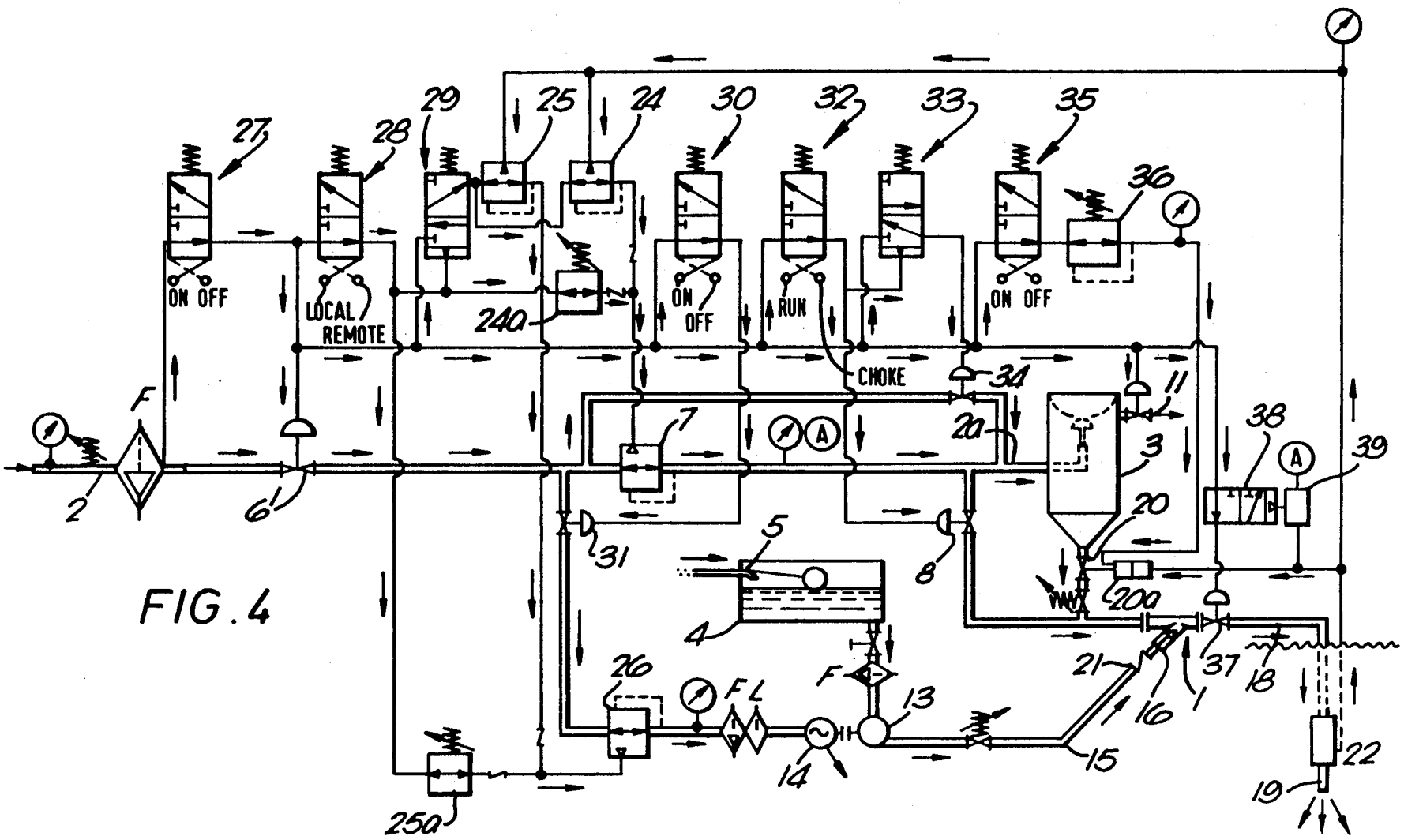
FIG. 4 shows a modified version of the apparatus of FIG. 3.

For extra security against leaks or failures, an additional valve 37 may be fitted between mixing zone 1 and outlet 17, as shown in FIGS. 1, 3 and 4. Such a valve 37 may be automatically closing or normally-closed and may be associated with an on-off switch 98 as shown in FIG. 1. A conventional "non-return" or "check" valve may be provided in line 2 (not shown) as protection in case of failure of valve 8.

As will readily be appreciated, for underwater use in order to maintain the optimum relatively low nozzle pressure of e.g. at most around 100 psi (7 kg/cm$^2$) above ambient, the compressed air supply introduced into the system as motive and control power via inlet pipe 2 must always exceed the ambient pressure at the nozzle 19. A minimum overpressure of 25 psi (1.7 kg/cm$^2$) is desirable. Thus, the pressure of the liquid abrasive stream entering the discharge pipe 18 must be proportionally raised and the abrasive stream flow rate appropriately adjusted to allow for the greater local hydrostatic pressure encountered at the greater operational depths. This is suitably achieved by means of a conventional pressure sensing and transmitting device 22 fitted at the nozzle 19 to respond to changes in local hydrostatic pressure. A pressure gauge 23 is provided in the apparatus to indicate to surface operators the working depth and/or hydrostatic pressure.

The pressure sensing and transmitting device 22 acts by sending a signal to the surface, which can be used to automatically control both a pilot control regulator 24 acting on the regulator 7 controlling the main compressed air flow, and a pilot control regulator 25 acting on a regulator 26 controlling the compressed air motor 14. An amplifier (not shown) may be used to boost this signal if desired.

Referring particularly to FIG. 1, a differential pilot control switch 99 or the like will preferably be used to de-pressure or switch the air supply or electrical signal from or to the valve actuators 8, 11*a*, 20*a* and 37*a* causing them to close should the pressure of the main compressed air supply entering the system via pipe 2 fall to, or near to, the nozzle ambient pressure, as detected by 22. A "priming" switch 43 is furnished to initially charge the pressure sensing line, and to replenish that line in case of leakage. This may be linked to an on-off switch 27 to ensure closure of all system valves whilst priming.

Manual override regulators 24*a* and 25*a* are generally provided in addition to pilot control regulators 24 and 25 for additional security or as an alternative should a "manual control only" system be preferred. Regulator isolating valves and non-return valves are also provided.

To ensure bubble tight closure of valve 20 at the very high back pressures obtaining from operation at depth an alternative version may be used whereby that same hydrostatic pressure obtained via 22 is fed to the actuator 20*a* of valve 20 to apply a closing force equal to or greater than the resultant back pressure acting on the valve internals to open the valve. A spring may additionally be fitted to assist the closing force. The valve can be opened as desired to allow grit to be metered out of vessel 3 by the introduction of mains air onto the "opening" side of valve actuator 20*a* via a switch and control regulator. Although applicable to either of the apparatus illustrated in FIGS. 2 or 4, such a modification has, for clarity, only been incorporated into the illustration of FIG. 4. In that figure, the switch is designated 35 and control regulator 36.

FIGS. 3 and 4 show generally apparatus incorporating pneumatic (or alternatively hydraulic or electrical) controls on the valves 8, 20 and 37 and the water pump 13 in a manner which offers very fast valve response times and generally improves the security and ease of operator control, particularly when very deep underwater operations are involved.

In FIGS. 3 and 4, therefore, the main compressed air on/off control valve 6 in FIGS. 1 and 2 is replaced by a normally-closed valve 6' arranged to be opened and shut via a system on/off switch 27. Simultaneously as the switch 27 is put to the "on" position all other control switches become "live".

A manual auto-control switch 28 isolates the remote pilot regulators 24 and 25 and brings on-stream the manual pilot regulators 24*a* and 25*a*, or vice-versa, eliminating the need to close one regulator before operating the other every time. A pilot switch 29 acts as the actuator.

A pump on-off switch 30 in conjunction with an auto-closing normally-closed valve 31 ensures that the pump 13 will stop as soon as the system switch 27 is put to "off", as well as giving independent pump control.

For further ease of operation, the apparatus shown in FIGS. 3 and 4 incorporate additionally means for assisting the smooth flow of grit from the grit vessel 3. Thus, a choke switch 32 together with a pilot operator 33 and a normally-open by-pass valve 34 provide a means whereby the valve 8 may be closed during normal operations in the event of a failure of the abrasive flow from vessel 3, to put full inlet air pressure into vessel 3 to assist the grit flow The pilot operator 33 would cause valve 34 to open while switch 33 was held in the "Choke" position; and valve 8 closed.

A grit switch 35 and regulator 36 supply air to the "opening" side (underside) of the pneumatic actuator of the normally-closed valve 20 (as in FIG. 4), applying a counter pressure to that applied to the "closing" side (topside) of the actuator from 37*a* (as in FIG. 3) or 22 (as in FIG. 4), allowing the valve to open.

The back-up safety shut-off valve 37 may operate in similar fashion to valve 20, as described above, or may alternatively be as shown in FIG. 4, a conventional normally-closed valve A safety interlock may be used, by way of a differential pilot pressure switch 38 (as shown in FIG. 3), or by way of a pilot switch 38 and a pressure switch 39 (as shown in FIG. 4), or the like, whereby no signal is passed to valves 20 and 37 (in the case of FIG. 3) or to valve 37 (in the case of FIG. 4) to open until the system pressure at (A) is greater than nozzle ambient pressure at 22.

As shown by way of example in FIG. 3, a similar safety interlock 38 A may be fitted on the compressed air feed line to "on-off" switch 27, preventing any of the system from becoming live unless the inlet air pressure at 2 is greater than the ambient pressure at 22.

Figure 5:
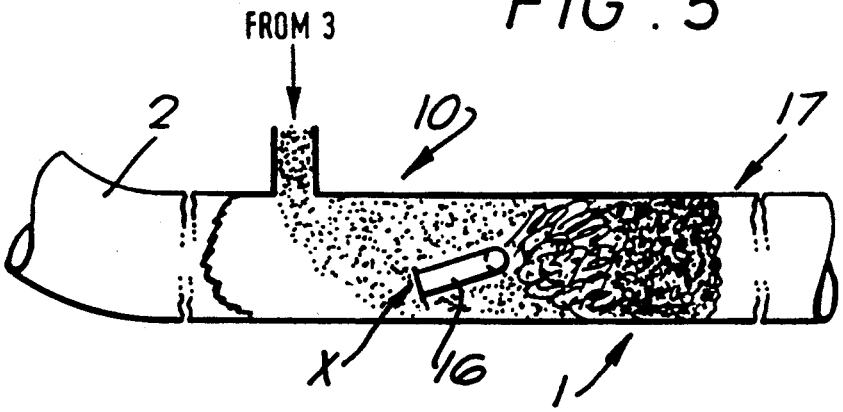
FIG. 5 shows a partially cut-away side elevation view (not to scale) of a mixing zone.

FIG. 5 illustrates in more detail the construction of a mixing zone 1, of generally cylindrical form and of substantially the same diameter as the air line 2. The water supply line (illustrated by arrow X) communicates to a Y-branch 16 which permits the water to enter from the side to impinge on a stream of abrasive particles entering the inlet region 10 from the abrasives hopper 3. No atomising head is present at the Y-branch 16.

The turbulence and other factors already described cause the particles to become wetted in accordance with the invention, so that the abrasive stream leaves the mixing zone at the outlet region 17.

It is particularly preferred to use "fail safe to close" valves at 20 and/or 37 which have closure springs of sufficient strength to maintain closure even in the event of a total compressed air supply failure. The valve is illustrated in FIGS. 6 to 10 of the accompanying drawings and will be described with additional reference to FIG. 3, in which such a valve and associated controls are schematically represented.

Referring to FIGS. 6 to 10, the valve is formed by a rubber sleeve 'e' which is held firmly in the concentric bores of two halves of an outer housing, 'a' and 'b'. The free length of the sleeve is slightly greater than the combined length of the two bores in which it is located, so that it is always under longitudinal compression.

The rubber sleeve 'e' is produced with an outer diameter the same or slightly larger than the bore in the housings to produce a mild interference fit. The ends of the sleeve are flat and square to the bore of the sleeve.

The bottom 'o' of each of the housing bores is preferably machined conically at an angle of between 5° and 15° to the horizontal, so as to create a constant "nip" or "set" onto each end of the sleeve when the unit is assembled, the greatest nip being exerted towards the bore of the sleeve, and the machined surfaces facing away from the axis of the tube.

Thus, when the sleeve is subjected to either internal or external forces, or both, the ends of the sleeve will remain sealed against the ends of the bores.

For gravity discharge the valve assembly is normally mounted with the bore vertical, as illustrated in FIG. 6, so that housing half 'a' would be the lower half and 'b' the upper. For pumped or pressure discharge the assembly may be mounted in any plane.

The inner or joint face of one or both halves is machined out in a rectangular shape with rounded corners, as shown in FIG. 7, to a sufficient depth to give adequate clearance to two nip heads 'c' and 'd', which may suitably be in the form of rollers, when the two housing halves are bolted together, as shown.

When the sleeve 'e' is fitted into the two housing halves the nip heads lie to opposite sides of the sleeve.

A pneumatic actuator 'k' (designated 20a in FIG. 3), which may be of a standard commercial make (or may alternatively be a conventional electrical or hydraulic actuator), is fitted to one side of the housing assembly via support rods 'n', as shown, in such a way that when the actuator is de-activated an actuator shaft 'j' can travel (extend) a further distance than the bore diameter of the rubber sleeve 'e', pushing nip head 'd', which in turn will squeeze the sleeve closed to tightly seal the orifice or passage through the sleeve.

A spring 'm' is fitted around the actuator shaft 'j' against retainer 'l' having sufficient force when under compression to completely extend shaft 'j' and close the sleeve bore when the actuator is de-activated against the combined working pressure force on the bore of the sleeve and the inherent resistance of the sleeve to compression.

A double acting actuator as shown in FIG. 3, may alternatively be used to provide additional power to extend the actuator shaft in high working pressure conditions.

The actuator is so designed that when the power is applied to it to extend or retract the shaft, it will overcome the spring force 'm' and fully retract the shaft 'j' allowing the sleeve to return to a fully open bore, as shown in FIGS. 6 and 7, in which the actuator 'k' is actuated or "live".

Nip head 'c' is controlled by means of a manually operable handwheel 'g' (designated 69 in FIG. 3) which carries a scale 'p' and pointer (as shown in FIG. 8), and which rotates a handwheel shaft 'f' screw-threaded through a shaft support 'h' mounted to the side of the valve housing 'a', 'b' via support rods 'i' extending from the housing. The screw pitch is typically about 1 mm. The shaft support may alternatively (not shown) be integral with, or mounted directly to, the valve housing if desired.

Figure 9:
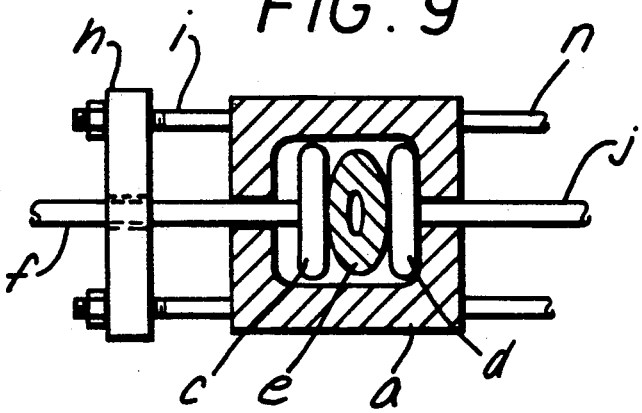
FIG. 9 shows a view taken in the same manner as FIG. 7 with the valve partly closed.

The handwheel shaft 'f' bears against nip head 'c' so that, for a conventional thread, as the handwheel is turned clockwise the shaft 'f' will push nip head 'c' onto sleeve 'e', and when turned anti-clockwise it will release pressure from the nip head allowing the sleeve to expand back FIG. 9 illustrates the arrangement after the handwheel has been turned sufficiently to extend shaft 'f' 50% of its normal travel, thus restricting the size of the orifice through the sleeve through which the media to be controlled must pass.

Figure 10:
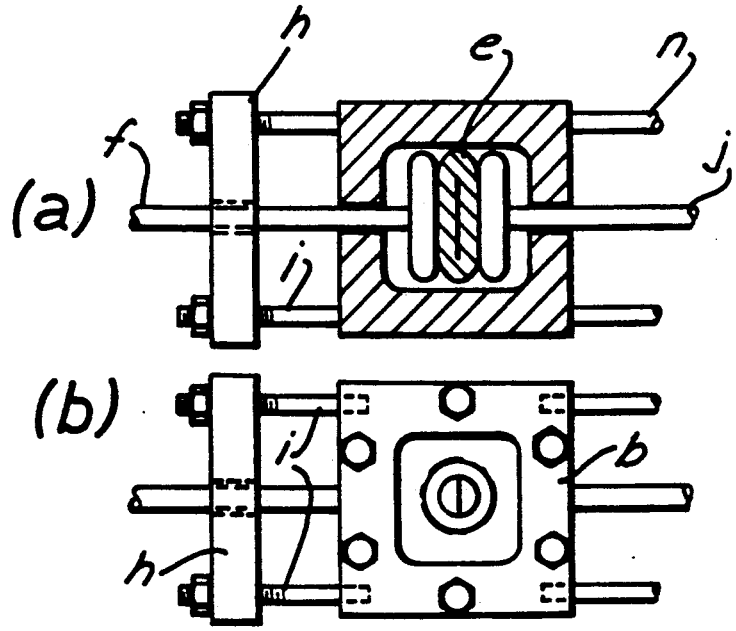
FIG. 10 shows (a) a view taken in the same manner as FIG. 7 with the valve fully closed, and (b) a top view of the valve of FIG. 6 with the valve fully closed.

In FIG. 10, the handwheel has remained in the same position as in FIG. 9, but the actuator has been deactivated and shaft 'j' and nip head 'd' have been pushed under spring pressure to fully close the sleeve orifice. This position is also shown by the dotted lines in FIG. 6.

The preset partial closure of sleeve 'e' can be varied from fully opened to fully closed by ensuring a sufficient length of thread on shaft 'f'. The degree of closure can be shown to the operating personnel either by having, attached to the housing assembly, a linear indicator aligned against a mark or markings on the shaft 'f' (not shown), or as illustrated in FIG. 10, a gravity dial indicator may be used, where one rotation of the handwheel or handle moves the pointer one graduation on the dial, which equals one pitch length of the thread.

Thus the valve aperture may be infinitely varied to give accurate flow control, the valve will close bubble tight automatically on switch off or power failure, and it will open again repeatedly to the preset aperture on switching on again.

For high pressure service and for handling dangerous substances, glands or seals may be fitted where the two shafts 'j' and 'f' pass through the housings.

Pressure gauges, filters F, lubricators L, valves, safety relief valves etc. may generally provided at suitable places in the apparatus in conventional manner. Where not specifically described above, manual controls M for the automatic valves are provided in conventional manner. Hot water or steam jackets, e.g. for the grit vessel, water tank, mixing zone and water pump and motor, may also be present to improve performance and water flow and to prevent icing up in cold weather.

Industrial Applicability

It is found that the safety and efficiency of the apparatus of the invention is extremely high compared to any previously known systems, and that less and cheaper abrasive can be used for a given operation than hitherto. It is also found that the very low vibration level at the nozzle and the very low reverse thrust makes the apparatus very suitable for use with remote-operated vehicles. In particular, using the apparatus of the invention cleaning rates can be improved by factors of between 8:1 and 15:1 compared to prior systems, with abrasive consumption reduced by 15 to 30 times compared to prior high pressure systems (depending on factors such as operating depth and the hardness and thickness of the dirt or coating to be removed or cut).

Some of the potential benefits of the present invention in its various aspects, when embodied in an underwater abrasive cleaning or cutting apparatus, may be summarised as follows:

(a) it allows the motive power for propelling the cleaning or cutting medium against the object to be cleaned or cut to be provided by compressed air or gas;

(b) it allows the abrasive mixture to be discharged from a single outlet via a single flexible hose or pipe leading from the mixing zone to the nozzle;

(c) it allows an air compressor to be sued either external to or inside the apparatus housing;

(d) it allows the relative proportions of the ingredients of the abrasive mix to be varied to suit the nature of the cleaning or cutting task;

(e) it allows the discharge pressure and velocity of the abrasive medium to be adjusted manually to suit the nature of the task and the depth of underwater operation;

(f) it allows the hydrostatic pressure at the nozzle to be monitored;

(g) it allows either or both of (i) the proportions of the ingredients of the abrasive mix and (ii) the discharge pressure and velocity of the mix to be automatically adjusted to suit the ambient pressure at the nozzle;

(h) it allows the discharge pressure of the abrasive medium at the nozzle to be maintained up to about 100 psig (7 kg/cm$^2$), normally about 30 to 50 psig (2.1 to 3.5 kg/cm$^2$) above the ambient pressure at the nozzle;

(i) it allows monitoring and control devices to be operated manually, pneumatically, hydraulically or electronically;

(j) it allows the nozzle to be held and manipulated by a diver or a remote operated vehicle with equal facility without the need for thrust or vibration compensators;

(k) it allows air to be fed from a compressor or external power source, liquid to be fed from a pump and abrasive particles to be fed from a pressurised container, with each inlet into the mixing zone and the outlet from the mixing zone having independent manually or automatically actuable valve means to isolate the respective inlet or outlet;

(l) it allows the isolating valves mentioned in (k) to be controlled in such a way that they will automatically close in the event that the system discharge pressure should fall below the nozzle ambient pressure, thus preventing a back-flow of wet air or water back into the apparatus when either the flow or pressure of propellant is insufficient to overcome the ambient pressure, or when the apparatus is deactivated and de-pressurised; and (m) it enables products such as concrete, which is commonly applied to underwater oil and gas pipelines as an all round protective casing some 3" to 4" (75 mm to 100 mm) thick, and known as "weight coating", to be cut through safely, efficiently, and leaving a relatively clean, unbroken, edge suitable for allowing the removal of complete sections of such casing, in one or more pieces as required, using manual or mechanical means.

I claim:

1. Apparatus for underwater abrasive cleaning and/or cutting, comprising:

a mixing zone for preparing an abrasive mixture comprising abrasive particles, air and a liquid;

means for controlledly supplying the abrasive particles, air under pressure, and liquid to the mixing zone in such a way that a resultant abrasive stream includes abrasive particles substantially surface-wetted by the liquid and entrained in air or an air/liquid mist as an abrasive carrier;

an outlet nozzle for directing the abrasive stream at an underwater surface to be cleaned and/or cut;

a pipeline connecting the mixing zone to the outlet nozzle for conveying the abrasive stream to the nozzle; and means for adjusting the flow rates of the abrasive particles, air and liquid and the mixing zone pressure, relative to each other, depending one the working depth of the nozzle underwater, so as to discharge an abrasive stream of composition as set forth above through the nozzle at a pressure less than about 100 psig (7 kg/cm$^2$) above the ambient hydrostatic pressure at the nozzle.

2. Apparatus according to claim 1, wherein the mixing zone is provided with a first inlet port for receiving a stream of air carrying abrasive particles and a second inlet port, downstream of the first inlet port, for receiving a supply of liquid.

3. Apparatus according to claim 2, wherein the second inlet port is arranged so that the liquid passing therethrough impinges on the stream of air carrying abrasive particles in such a way that the liquid breaks into droplets of a size generally similar to, or somewhat larger than, the size of the abrasive particles.

4. Apparatus according to claim 2, wherein the means for supplying the abrasive particles and air to the mixing zone comprise a pressurized air lien and a bypass line leaving the air lien, entering a pressurized container for abrasive particles, leaving the container carrying entrained abrasive particles and rejoining the air line upstream of the point of supply of the liquid.

5. Apparatus according to claim 1, wherein the means for supplying the liquid to the mixing zone comprise a pneumatically powered pump.

6. Apparatus according to claim 1, wherein valve means are provided to control the flow of at least one of the abrasive particles, the air, the liquid and the abrasive mixture prepared therefrom.

7. Apparatus according to claim 1 wherein valve means are provided upstream and/or downstream of the mixing zone actuable to restrict or prevent flooding of surface apparatus due to reverse-flow of abrasive mixture in the pipeline.

8. Apparatus according to claim 6 or claim 7, wherein at least one of the valve means is actuable in response to local hydrostatic pressure at the nozzle.

9. Apparatus according to claim 6 or claim 7, wherein at least one of the valve means has an adjustable extent of closure and may be pre-set to provide a desired degree of closure when actuated.

10. Apparatus according to claim 6 or claim 7, wherein at least one of the valve means comprises a resilient tube snugly retained under longitudinal compression within a chamber and seated therein by expansion against abutments provided int he chamber, the arrangement being such that the respective flowable medium may pass through the tube in use and means being proceed for wholly or partially constricting the tube, wherein the abutments in the chamber are so shaped that at least part of the surface against which the tube is seated faces away from the axis of the tube.

11. Apparatus according to claim 1, wherein the pipeline is a single flexible hose or pipe.

12. A method of underwater abrasive cleaning and/or cutting, wherein an abrasive stream comprising a mixture of abrasive particles, air and a liquid and including abrasive particles substantially surface-wetted by the liquid and entrained in air or an air/liquid mist as an abrasive carrier is initially prepared in a pressurized mixing one and subsequently directed, at a pressure less than about 100 psig (7 kg/cm$^2$) above the ambient hydrostatic pressure, at an underwater surface to be cleaned and/or cut, the method further including manually and/or automatically adjusting the flow rates of the abrasive particles, air and liquid and the mixing zone pressure, relative to each other, depending one the working depth of cleaning and/or cutting so as to provide the abrasive stream composition and pressure as set forth above.

13. A method according to claim 12, wherein from 80 to 100% of the liquid in the abrasive stream goes to substantially encapsulating at least a majority of the abrasive particles and the remainder, if any, of the liquid goes to form the air/liquid mist.

14. A method according to claim 12, wherein from 90 to 95% of the liquid in the abrasive stream goes to substantially encapsulating at least a majority of the abrasive particles and 5 to 10% of the liquid goes to form the air/liquid mist.

15. A method according to claim 12, wherein the abrasive stream is prepared by allowing a supply of liquid to impinge on a stream of air carrying abrasive particles within a pressurized mixing zone, in such a way that the liquid breaks into droplets of a size generally similar to, or somewhat larger than, the size of the abrasive particles.

16. A method according to claim 12, wherein the motive power for propelling the abrasive mixture against a surface to be cleaned and/or cut is provided by compressed air.

* * * * *